US007325808B1

(12) United States Patent
Adler et al.

(10) Patent No.: US 7,325,808 B1
(45) Date of Patent: Feb. 5, 2008

(54) TARGET RANGE SYSTEMS

(75) Inventors: Elliott J. Adler, Knoxville, TN (US); William M. Pearse, Lenoir City, TN (US); Erik S. Quist, Knoxville, TN (US); Michael W. Welch, Knoxville, TN (US)

(73) Assignee: EOD Technology, Inc., Lenoir City, TN (US)

( * ) Notice: Subject to any disclaimer, the term of this patent is extended or adjusted under 35 U.S.C. 154(b) by 0 days.

(21) Appl. No.: 11/381,595

(22) Filed: May 4, 2006

Related U.S. Application Data

(62) Division of application No. 10/902,444, filed on Jul. 29, 2004.

(51) Int. Cl.
*F41J 1/08* (2006.01)

(52) U.S. Cl. ..... 273/407; 273/406

(58) Field of Classification Search ..... 273/403–410
See application file for complete search history.

(56) References Cited

U.S. PATENT DOCUMENTS

| | | | | |
|---|---|---|---|---|
| 2,382,442 A | | 8/1945 | Rich et al. | |
| 3,685,830 A | * | 8/1972 | Holm | 273/348 |
| 4,184,681 A | | 1/1980 | Graham, Jr. | |
| 4,503,101 A | * | 3/1985 | Bennett | 428/9 |
| 4,691,925 A | | 9/1987 | Scholem | |
| 5,129,323 A | | 7/1992 | Park | |
| 5,211,404 A | * | 5/1993 | Grant | 273/407 |
| 5,280,920 A | * | 1/1994 | Knapper, II | 273/407 |
| 5,901,959 A | | 5/1999 | Tessiot | |
| 5,947,477 A | * | 9/1999 | Turnipseed | 273/407 |
| 6,808,177 B2 | | 10/2004 | DeHart | |
| 2003/0168813 A1 | * | 9/2003 | Wilkus | 273/407 |

FOREIGN PATENT DOCUMENTS

| | | |
|---|---|---|
| EP | 0 349 684 A1 | 10/1990 |
| EP | 0 640 809 B1 | 3/1995 |
| JP | 60 26 798 | 2/1994 |

* cited by examiner

*Primary Examiner*—Mark S Graham
(74) *Attorney, Agent, or Firm*—Luedeka, Neely & Graham, PC

(57) ABSTRACT

Targets, a target range system, and methods for economical operation of a target range. A preferred method includes providing a target range site; providing a target resembling a conventional target in dimension and appearing, yet having a weight that is substantially less than the weight of the conventional target. The target has a plurality of interconnecting plates made of recyclable material and is devoid of hazards comprising munitions, fuels, and radioactive materials. The ingress and egress routes for the target are reduced as compared to routes for conventional targets and enable cost savings. The targets are also readily recycled, enabling additional economic advantage.

10 Claims, 21 Drawing Sheets

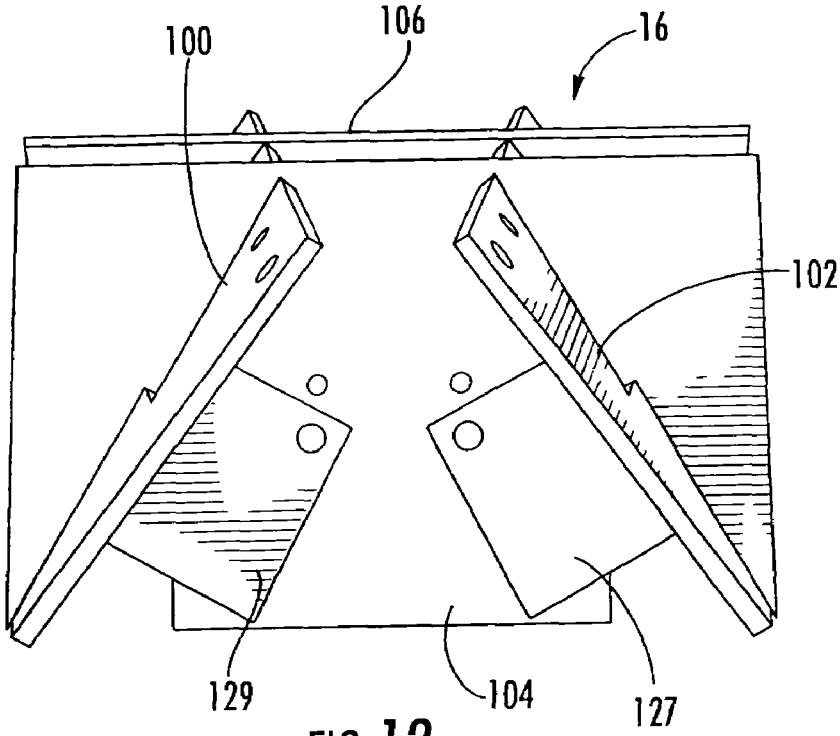
FIG. 12
FIG. 14
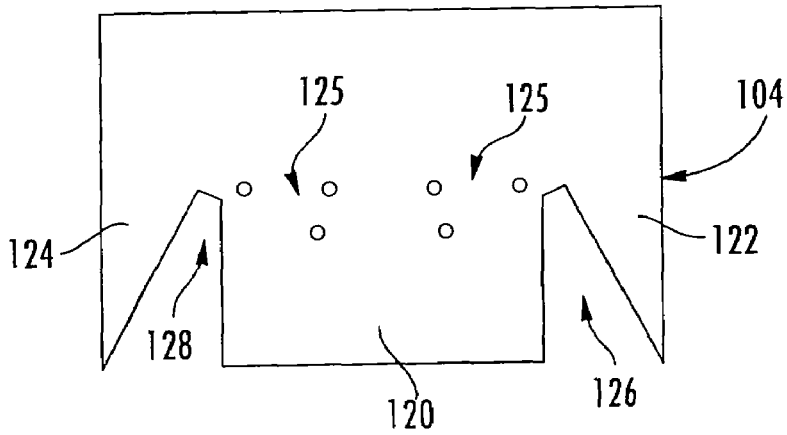
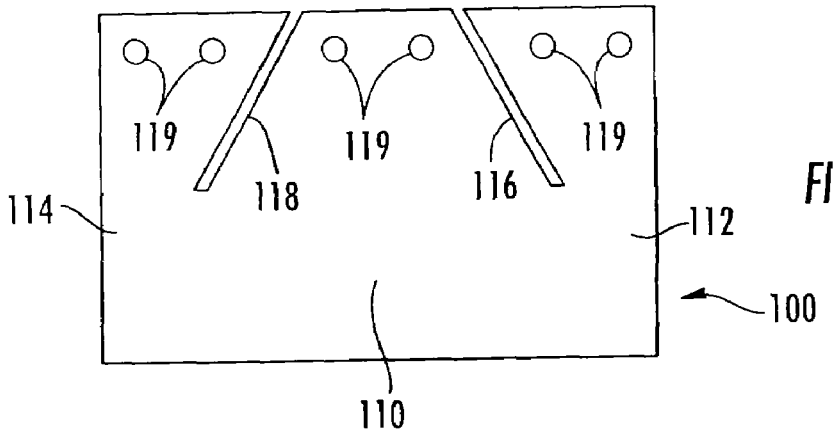
FIG. 13

TARGET RANGE SYSTEMS

CROSS-REFERENCE TO RELATED APPLICATION

This is a divisional application to U.S. application Ser. No. 10/902,444 filed Jul. 29, 2004, entitled "Target Range Systems."

FIELD OF THE INVENTION

This invention relates generally to targets and target ranges. More particularly, this invention relates to methods and apparatus for target ranges which facilitate placement and recovery of targets and reduce costs associated with the operation of target ranges.

BACKGROUND AND SUMMARY OF THE INVENTION

Military target ranges typically utilize surplus jeeps, tanks, and other vehicles which have been prepared for use as targets. Such preparation typically includes draining fluids such as gasoline, oils, and coolants, and checking compartments to remove ammunition or other hazards left behind. When hit by artillery or the like, such targets tend to fracture and blow apart, requiring periodic maintenance, as by pushing the remaining parts together using a bulldozer. At the end of the useful life of the targets, a recovery team must travel through or be present directly on the range, gather the pieces for removal, and again travel through or be directly present on the range for removal. As such, the travel path must be inspected for unexploded ordnance and the like to ensure safe ingress and egress. Furthermore, the recovered debris must be inspected for hazards and otherwise processed, and is generally not readily accepted for salvage.

The present invention advantageously provides an improved target range system and related methods and apparatus that offer many improvements over conventional targets, target ranges, and operation of target ranges.

For example, the present invention advantageously utilizes target devices configured to facilitate installation and removal. The targets are devoid of initial hazards and may be airlifted into and from the target range to minimize ingress/egress routes and reduce installation and recovery costs. The targets are also configured to remain substantially intact, e.g., to not fragment or otherwise blow apart, and to be readily recycled at the end of their useful life.

With regard to the foregoing, in one aspect, the present invention is directed to a method for operating a target range.

In a preferred embodiment, the method includes the steps of providing a target consisting of a first pair of plates each having a pair of grooves and a second pair of plates configured for being received by the grooves of the first plates, wherein the plates are made of a recyclable material and are devoid of hazards comprising munitions, fuels, and radioactive materials. The target is assembled by positioning the first plates in a parallel and side by side orientation and positioning each one of the second pair of plates within the grooves of the plates of the first pair of plates such that the plates of the second pair of plates are spaced apart and substantially parallel to one another to provide an assembled target. The assembly may occur off-range or on-range. The target is positioned on a target range and repeatedly subjected to impacts from ordnance or munitions, with the assembled target substantially remaining in the assembled state after such impacts. The target is then removed from the target range. The target may be removed in the assembled state or may be -dis-assembled prior to removal.

The method and the targets utilized therein enable significant economic advantages as compared to conventional methods for operating target ranges. Reduced costs are realized in the initial placement and the retrieval of targets, as the targets utilized in the method have reduced labor costs associated with their placement and retrieval. For example, the targets utilized do not require the careful inspection of conventional targets to remove hazards. Also, the targets are much lighter than conventional targets and may be positioned as by helicopter or by smaller ground vehicles, thus reducing the labor costs associated with clearing safe ingress and egress routes. In addition, the targets and their manner of use in the method avoid the maintenance normally associated with conventional targets and are readily recyclable at the end of their duty cycle, enabling further economic advantage as compared to conventional targets.

Thus, the invention provides a business method for economical operation of a target range, the method including the steps of providing a target range site; and providing a target resembling a conventional target in dimension and appearing, yet having a weight that is substantially less than the weight of the conventional target. The target has a plurality of interconnecting plates made of recyclable material and devoid of hazards comprising munitions, fuels, and radioactive materials.

An ingress route is provided for placement of the target on the target range site. The ingress route has a reduced dimension as compared to a conventional ingress route for the conventional target. The target is positioned on a target range site via the ingress route and repeatedly subjecting the target to impacts from ordnance or munitions. The target substantially remains substantially intact after such impacts.

An egress route is thereafter provided for removal of the target from the target range site. The egress route has a reduced dimension as compared to a conventional egress route for the conventional target and the target is removed from the target range site via the egress route. The reduced dimensions of the ingress/egress routes enable considerable cost savings, as the costs to clear ingress/egress routes of unexploded ordnance and the like represents considerable expense in both time and expense.

In another aspect, the invention relates to a target range system. The system includes a tract of land suitable for use a target range; and a plurality of three-dimensional targets positioned on the tract of land. Each target has a first pair of plates each having a pair of grooves and a second pair of plates configured for being received by the grooves of the first plates and supported by the first pair of plates. The plates are made of a recyclable material and are devoid of hazards including munitions, fuels, and radioactive materials.

In yet another aspect, the invention relates to a target having a first pair of plates each having a pair of grooves and a second pair of plates configured for being received by the grooves of the first plates and supported by the first pair of plates. The target is substantially self-supporting and the plates are made of a recyclable material and are devoid of hazards including munitions, fuels, and radioactive materials.

BRIEF DESCRIPTION OF THE DRAWINGS

Further features of preferred embodiments of the invention will become apparent by reference to the detailed description of preferred embodiments when considered in conjunction with the figures, which are not to scale, wherein like reference numbers, indicate like elements through the several views, and wherein.

FIG. 12 is a side view of a target according to a still further embodiment of the invention.

FIG. 13 is a plan view of a side component of the target of FIG. 12.

FIG. 14 is a plan view of an end component of the target of FIG. 12.

DETAILED DESCRIPTION

Figure 1:
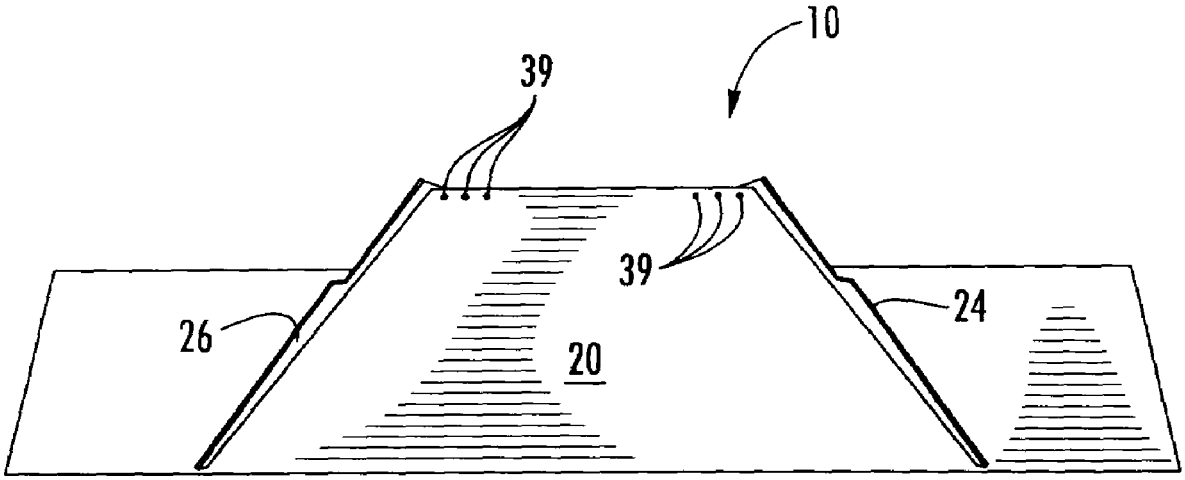
FIG. 1 is a side view of a target according to one preferred embodiment of the invention.
Figure 2:
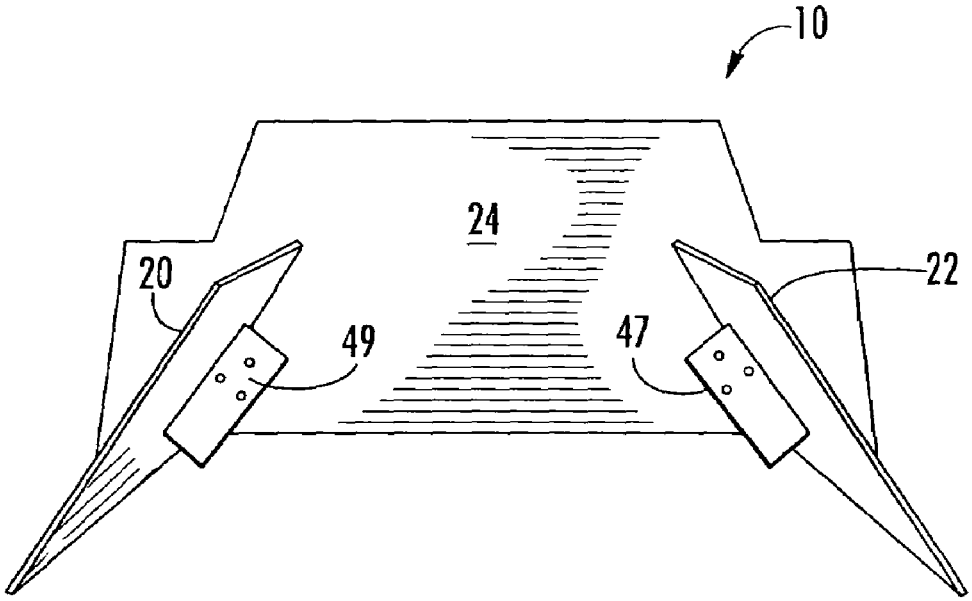
FIG. 2 is an end view of the target of FIG. 1.

The present invention relates to an improved target range system and related methods and apparatus that offer many improvements over conventional targets, target ranges, and operation of target ranges. The invention enables significantly reduced range operation costs. For example, the targets utilized avoid the significant costs associated with inspection and preparation of targets associated with conventional targets. Also, the targets are much lighter and economical to transport and have reduced costs associated with their placement on the range and removal from the range. In addition, the targets are readily recyclable, with the revenues from recycling representing another manner of cost reduction.

Together, the targets and their utilization on a range which encompasses reduced transportation and installation/maintenance/removal requirements, and enhanced recycling characteristics, provide an overall range operation method having significant cost and environmental benefits as compared to conventional target ranges and the operation thereof.

The system preferably utilizes target devices configured to facilitate installation and removal thereof. The targets are devoid of initial hazards and are relatively lightweight and are more readily transported and may be airlifted into and from the target range to minimize ingress/egress routes and reduce installation and recovery costs. The targets are also configured to remain substantially intact, e.g., to not blow apart, and to be readily recycled at the end of their useful life. For example, and with initial reference to FIGS. 1-14, there are shown preferred examples of targets 10-16 for use with a target range system in accordance with the invention.

Each of the targets 10-16 are three-dimensional targets of modular construction, assembled from a plurality of interlocking plates of a material that is readily recyclable such as metals, preferably steel, or plastics. The targets 10-16 also offer 360° profiles that resemble the profiles of conventional targets such that the targets are suitable for training exercises involving both ground and air initiated ordnance. The targets 10-16 and other suitable targets are targets which are available under the trademark GREENTARGET from EOD Technology, Inc. of Lenoir City, Tenn.

With particular reference to FIGS. 1-4, the target 10 includes a pair of side plates 20 and 22 and a pair of end plates 24 and 26. Each of the plates 20-26 is preferably of a steel or plastic plate material. The plate material and thickness thereof is preferably selected to correspond to the type of ordnance expected to engage the target and other considerations associated with the range, such as ricochet potential of the ordnance and proximity of the target to range borders and the like. The plates 20-26 are configured to interconnect with one another to render the target 10 in a rigid and substantially self-supporting condition. The plates 20-26 are preferably configured such that the target 10 resembles a military tank in general appearance. However, it will be understood that the plates may be otherwise configured to provide targets having a wide variety of appearances.

Figure 3:
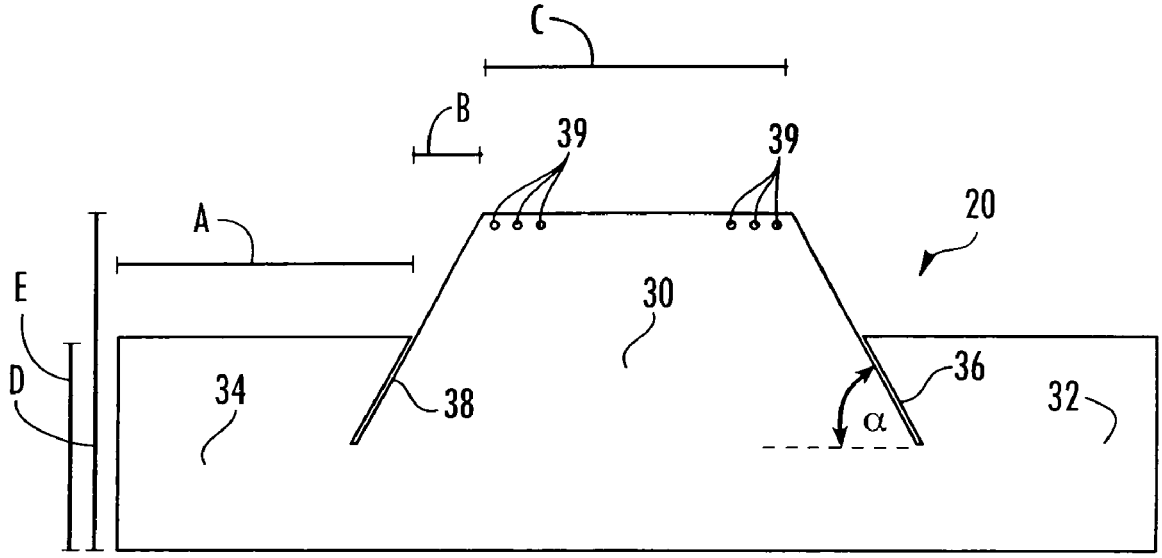
FIG. 3 is a plan view of a side component of the target of FIG. 1.

As seen in FIG. 3, side plate 20 is preferably of one-piece construction and defines a central portion 30 and a pair of end portions 32 and 34 on opposite sides of the central portion 30. Grooves 36 and 38 are defined at the juncture of the end portions 32 and 34 to the central portion 30 and are configured for receiving the end plates 24 and 26, each of which are preferably of plate material of the same thickness. Thus, for ¾ inch steel plate, the grooves are preferably about 1 inch wide, and cut at an angle $\alpha$ of preferably about 60 degrees. A plurality of apertures 39 are defined along an upstanding edge of the central portion 30 to serve as attachment points for connection of a lifting member, such as a cable, chain, or the like for transporting the target 10 as explained in more detail below. The side plate 22 is preferably of identical construction to the side plate 20.

For the purpose of example only, the side plate 20 preferably has the following dimensions:

| Dimension | Distance (inches) |
|---|---|
| A | 79 |
| B | 18.5 |
| C | 81 |
| D | 87 |
| E | 55 |

Figure 4:
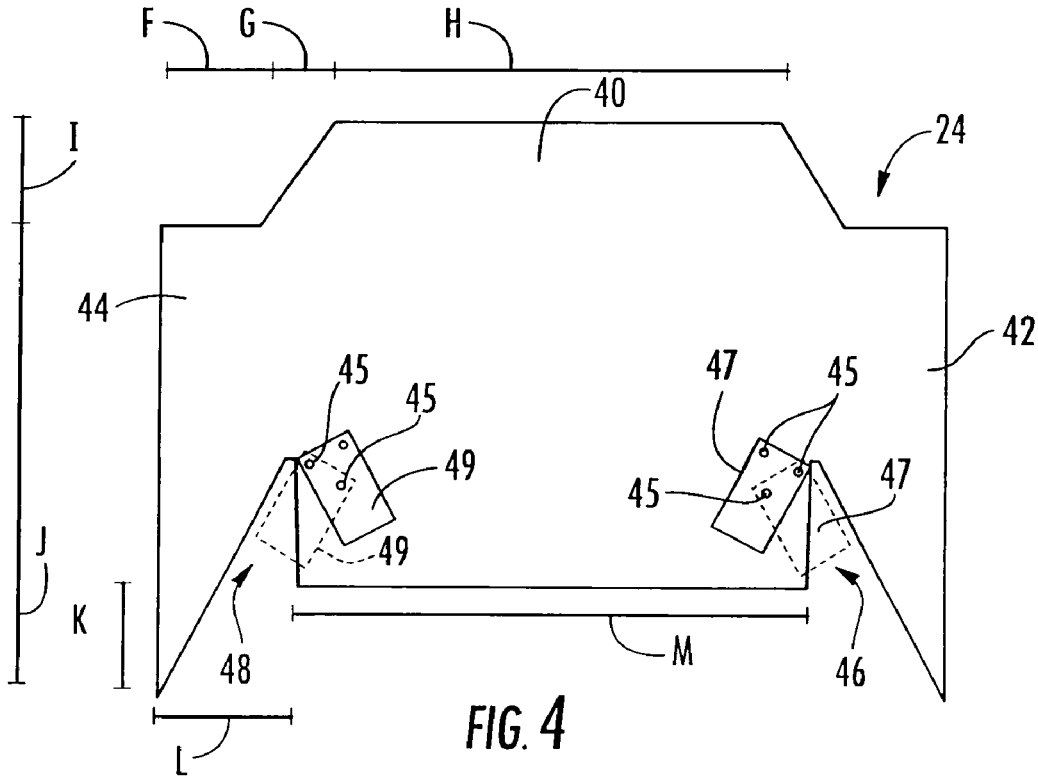
FIG. 4 is a plan view of an end component of the target of FIG. 1.

With reference to FIG. 4, the end plate 24 is preferably of one-piece construction and defines a central portion 40 and a pair of end portions 42 and 44 on opposite sides of the central portion 40. The end plate 26 is preferably substantially identical to the end plate 24. Cutouts 46 and 48 are defined a the juncture of the end portions 42 and 44 to the central portion 40 and are configured for being received by the grooves 36 and 38 of the side plates 20 and 22.

The cutouts 46 and 48 are preferably at an angled cut corresponding to the angle of the grooves 36 and 38. The plate 24 may preferably include a plurality of apertures 45 adjacent the cutouts 46 and 48 for attachment of reinforcements, such as gussets 47 and 49. In addition to gussets, it will be understood that suitable reinforcements may be utilized, including welded channels in the seams of the panels. Incorporation of the gussets 47 and 49 or other reinforcements help the target remain intact during lifting as by crane or helicopter during installation or removal of the target from a location.

As seen, the gussets 47 and 49 may be initially mounted to the plate 24 in a first orientation, as by fasteners which cooperate with the apertures 45, and then relocated to a second orientation, shown in phantom. The first orientation is selected to position the gussets out of the way of the cutouts 46 and 48, and the second orientation is selected to overlap the cutouts 46 and 48, such as after installation of the end plate 24 onto the side plates 20 and 22 to bear against the side plates 20 and 22 to help maintain the end plate 24 in place.

For the purpose of example only, the end plate 24 preferably has the following dimensions:

| Dimension | Distance (inches) |
|---|---|
| F | 16 |
| G | 6.5 |
| H | 87 |
| I | 32 |
| J | 55 |
| K | 16 |
| L | 17 |
| M | 98 |

Figure 5:
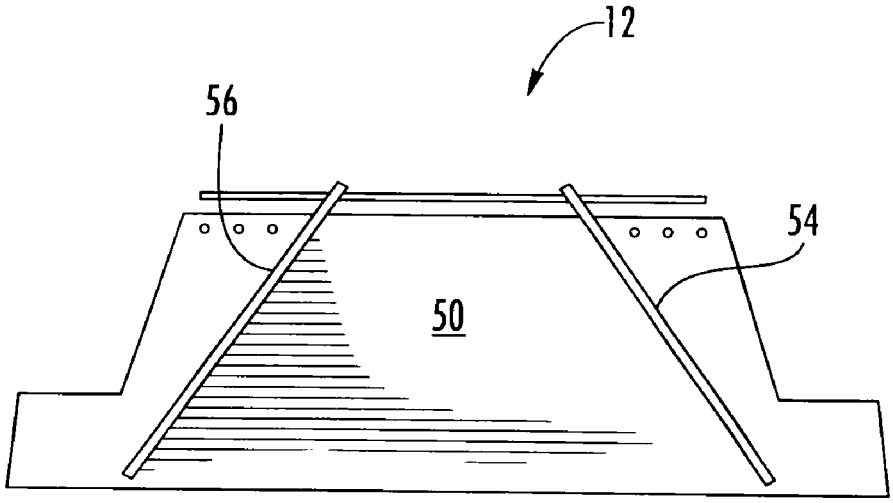
FIG. 5 is a side view of a target according to an alternate embodiment of the invention.
Figure 6:
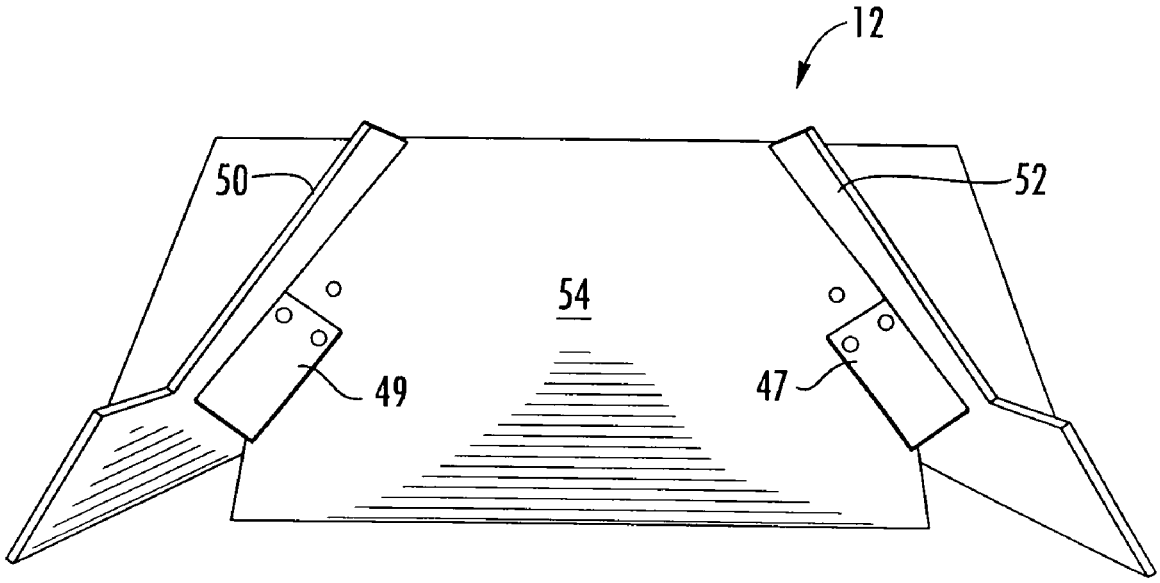
FIG. 6 is an end view of the target of FIG. 5.
Figure 7:
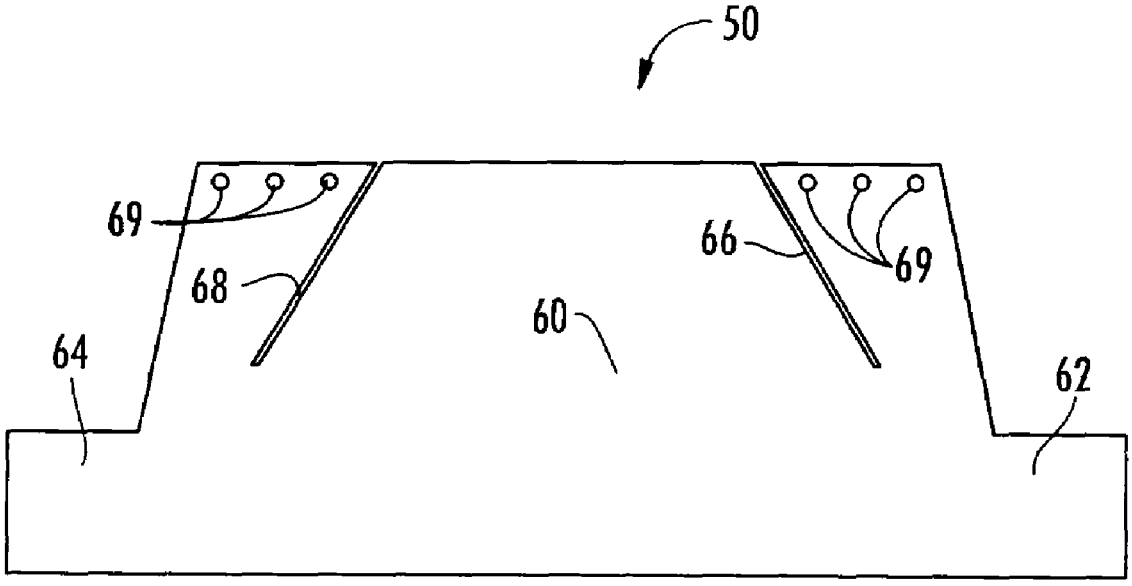
FIG. 7 is a plan view of a side component of the target of FIG. 5.
Figure 8:
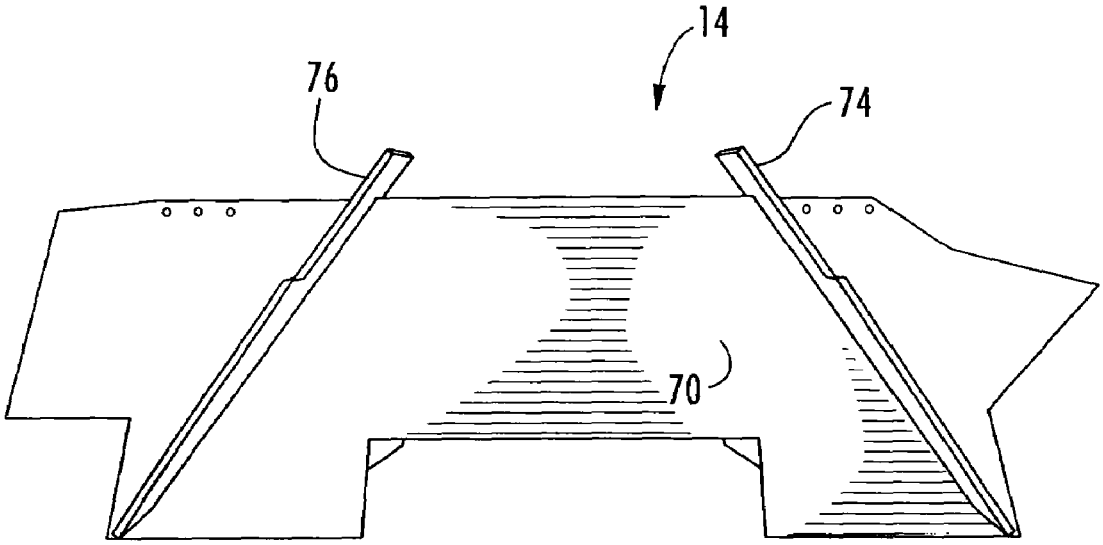
FIG. 8 is a side view of a target according to a further embodiment of the invention.
Figure 9:
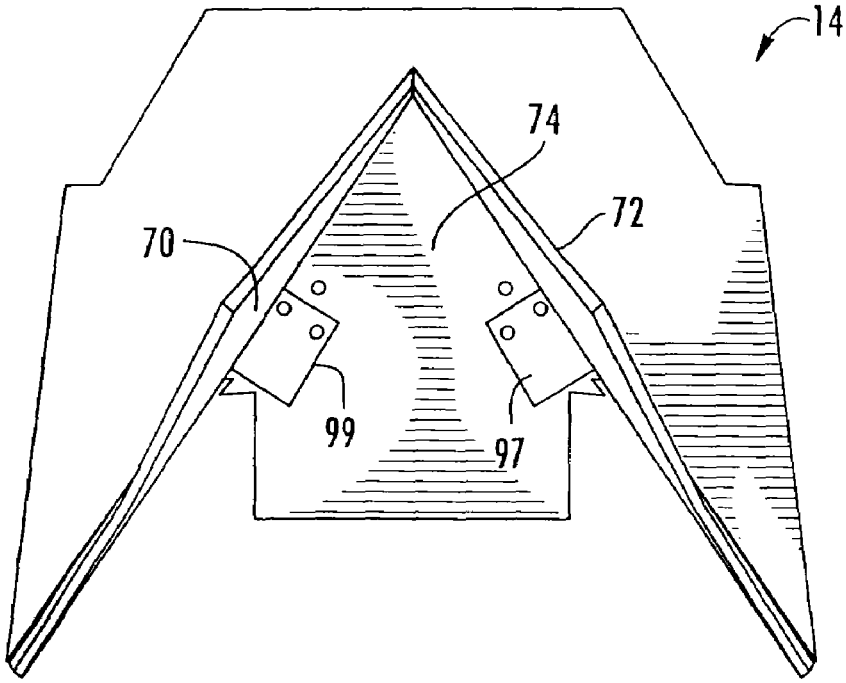
FIG. 9 is an end view of the target of FIG. 8.

With reference to FIGS. 5-7, the target 12 is of similar construction to the target 10 and includes a pair of a pair of side plates 50 and 52 and a pair of end plates 54 and 56. Each of the plates 50-56 is preferably of a recyclable material, such as steel or plastic plate material and are configured to interconnect with one another to render the target 12 in a rigid and self-supporting condition. The plates 50-56 are preferably configured such that the target 12 resembles a military tank.

As seen in FIG. 7, side plate 50 is preferably of one-piece construction and defines a central portion 60 and a pair of end portions 62 and 64 on opposite sides of the central portion 60. Grooves 66 and 68 are defined on the central portion 60 and are configured for receiving the end plates 54 and 56. A plurality of apertures 69 are defined along an upstanding edges of the central portion 60 outside of the grooves 66 and 68 to serve as attachment points for connection of a lifting member for transporting the target 12. The side plate 52 is preferably of identical construction to the side plate 50.

The end plates 54 and 56 are preferably identical to the end plates 34 and 36 described previously.

With reference now to FIGS. 8-11, the target 14 includes a pair of side plates 70 and 72 and a pair of end plates 74 and 76. Each of the plates 70-76 is preferably of a steel or plastic plate material and are configured to interconnect with one another to render the target 14 in a rigid and self-supporting condition. The plates 70-76 are preferably configured such that the target 14 resembles an armored military vehicle.

Figure 10:
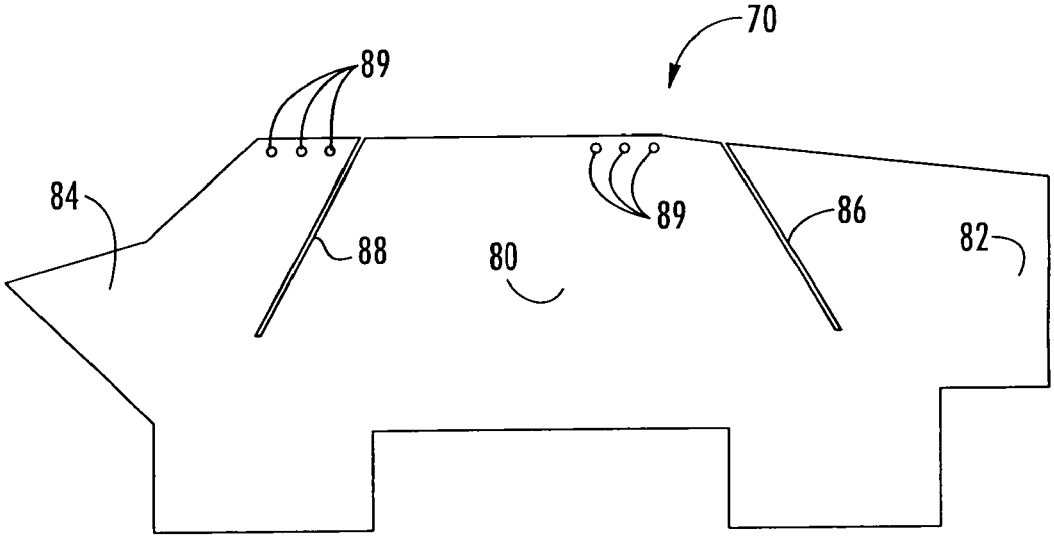
FIG. 10 is a plan view of a side component of the target of FIG. 8.

As depicted in FIG. 10, side plate 70 is preferably of one-piece construction and defines a central portion 80 and a pair of end portions 82 and 84 on opposite sides of the central portion 80. Grooves 86 and 88 defined on the side plate 70 are configured for receiving the end plates 74 and 76 and apertures 89 are defined along an upstanding edge of the plate 70 to serve as attachment points for connection of a lifting member for transporting the target 14. The side plate 72 is preferably of identical construction to the side plate 70.

Figure 11:
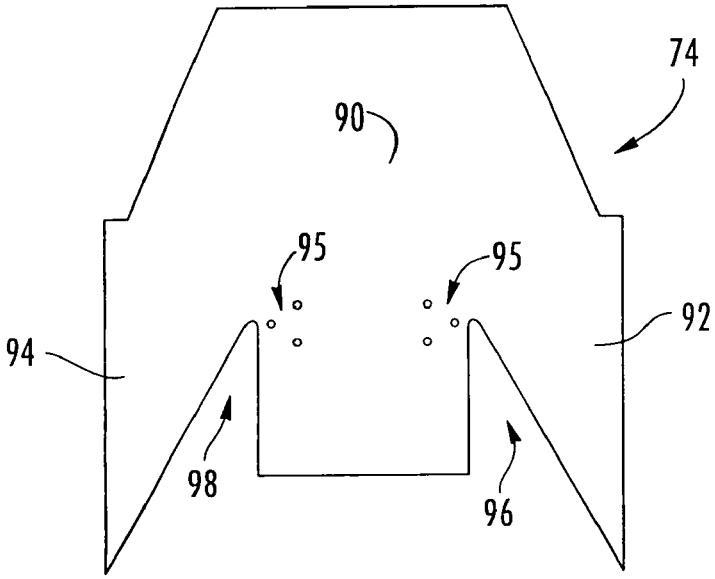
FIG. 11 is a plan view of an end component of the target of FIG. 8.
Figure 15:
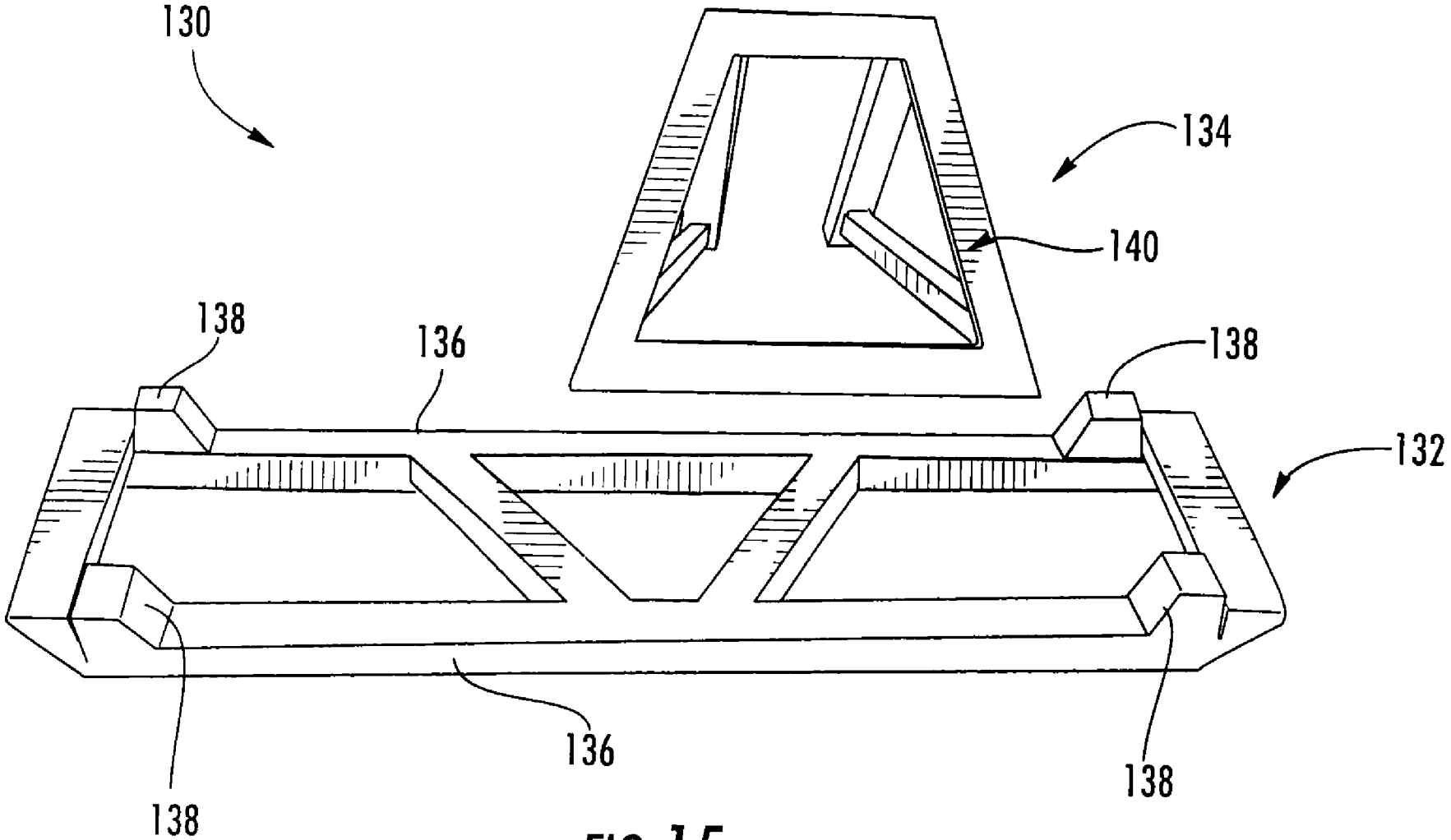
FIG. 15 is a perspective view of components of a preferred embodiment of a jig used for assembly of targets in accordance with the invention.

With reference to FIG. 11, the end plate 74 is preferably of one-piece construction and defines a central portion 90 and a pair of end portions 92 and 94 on opposite sides of the central portion 90. Cutouts 96 and 98 on the end plate 74 are configured for being received by the grooves 86 and 88 of the side plates 70 and 72. The plate 74 may preferably include a plurality of apertures 95 adjacent the cutouts 96 and 98 for attachment of gussets 97 and 99, which correspond to the previously described gussets 47 and 49. The end plate 76 is preferably substantially identical to the end plate 74.

With reference now to FIGS. 12-14, the target 16 includes a pair of side plates 100 and 102 and a pair of end plates 104 and 106. Each of the plates 100-106 is preferably of a steel or plastic plate material and are configured to interconnect with one another to render the target 16 in a rigid and self-supporting condition. The plates 100-106 are preferably configured such that the target 16 resembles a military bunker.

As seen in FIG. 13, side plate 100 is preferably of one-piece construction and defines a central portion 110 and a pair of end portions 112 and 114 on opposite sides of the central portion 110. Grooves 116 and 118 defined on the side plate 100 are configured for receiving the end plates 104 and 106 and apertures 119 are defined along an upstanding edge of the plate 100 to serve as attachment points for connection of a lifting member for transporting the target 16. The side plate 102 is preferably of identical construction to the side plate 100.

With reference to FIG. 14, the end plate 104 is preferably of one-piece construction and defines a central portion 120 and a pair of end portions 122 and 124 on opposite sides of the central portion 120. Cutouts 126 and 128 on the end plate 124 are configured for being received by the grooves 116 and 118 of the side plates 100 and 102. The plate 104 may preferably include a plurality of apertures 125 adjacent the cutouts 126 and 128 for attachment of gussets 127 and 129, which correspond to the previously described gussets 47 and 49. The end plate 106 is preferably substantially identical to the end plate 74.

Turning to FIGS. 15-25, there is shown a target assembly jig 130 and the use thereof for facilitating assembly of targets in accordance with another aspect of the invention. The jig 130 preferably includes a base or sled 132 and a pair of frames 134. The jig 130 may be made of any suitable material corresponding to the weight and size of the target to be assembled, and is preferably of welded tubular steel construction. However, it will be understood that the jig and the components thereof may be made of other suitable materials and combinations thereof, such as wood, plastic, carbon fiber, aluminum, and the like.

The sled 130 is primarily provided to maintain the frames 134 in a desired orientation relative to one another while the target is assembled. In this regard, the sled 130 is preferably a substantially rectangular frame configured for lying flat on the ground and having a pair of substantially parallel and spaced apart rails 136 for supporting the frames 134. A pair of angled stops 138 are provided at the ends of the rails 136 for abutting the frames 134 and for contacting lower portions of target components as described in more detail below.

Figure 16:
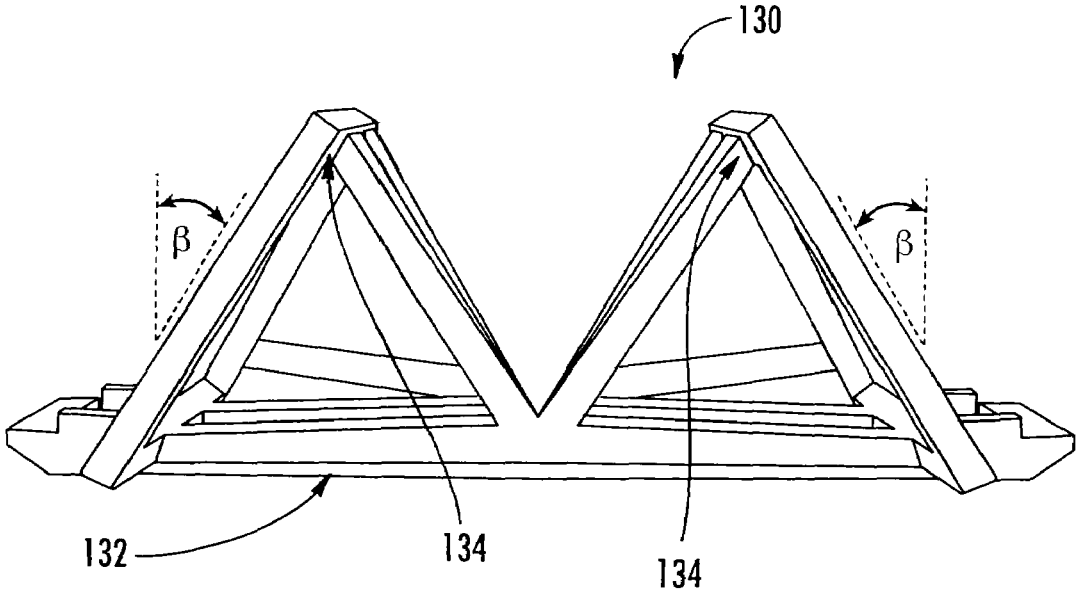
FIG. 16 is a side view of a jig made with the components of FIG. 15.
Figure 17:
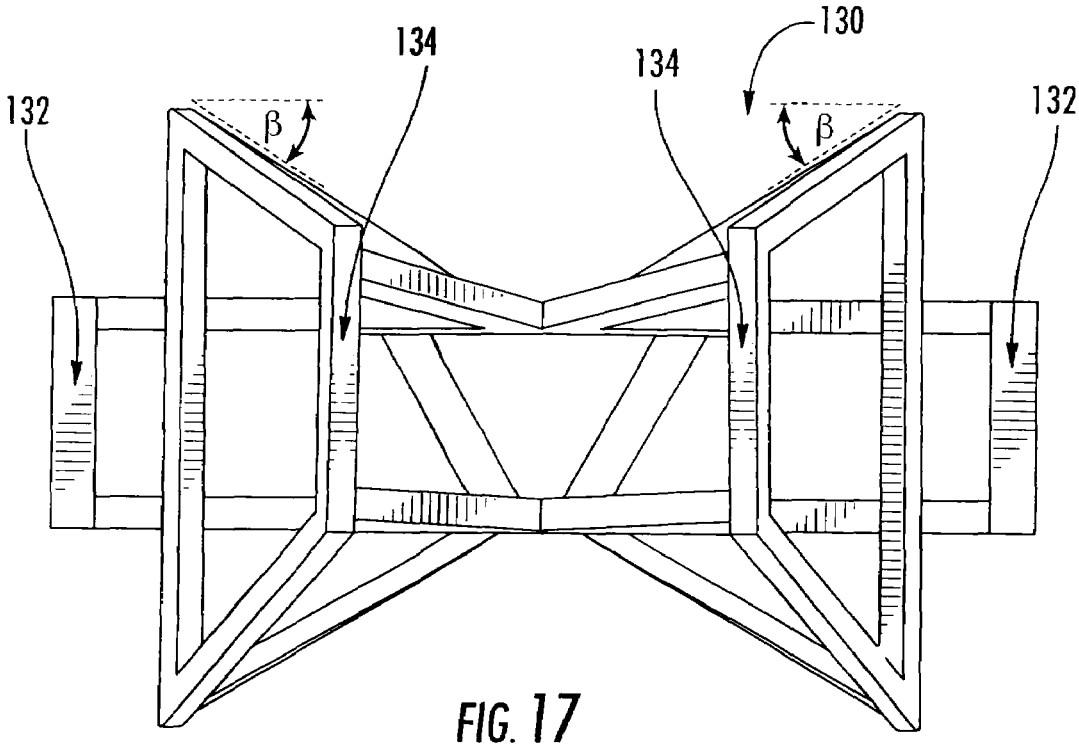
FIG. 17 is an overhead view of the jig of FIG. 16.

The length of the rails 136 and the length axis spacing of the stops 138 is preferably selected such that the frames 134 abut one another and the stops 138 (as shown in FIGS. 16 and 17) to fix the position of the frames 134 relative to the sled 132. It will be understood that the frames 134 may be fixed in position in other ways, as by fasteners and the like, and that the rails 136 and other components of the sled 130 may be of fixed or adjustable length, such as by utilizing telescoping tubing and position fixing devices such as fasteners.

The frames 134 are preferably identical to one another and made of tubular steel or the like and of fixed or adjustable dimension. Each frame 134 is configured so that the frames 134 may be placed on the sled 132 and provide a support face 140 against which components of the target to assembled may be supportably positioned.

As seen in the depicted frames 134, the support faces 140 are provided by frame members 142 which are spaced apart and oriented at a desired angle β relative to the sled 132. The angle β is selected so that the resulting target construction is essentially self-supporting and corresponds to the angle of the grooves of the side plates, such as the angle α described previously in connection with side plate 20, which angle is preferably the same for the various targets 10-16. Accordingly, for the depicted targets 10-16, the angle β is preferably about 60 degrees. Thus, the angle of the front/rear plates toward the center of the target, and for the side plates toward the center of the target, is preferably about 60 degrees from the horizontal or ground inward.

With further reference to FIGS. 18-25, there are shown preferred steps in the assembly of the target 16. The targets 10-14 may be assembled in an identical manner.

Figure 18:
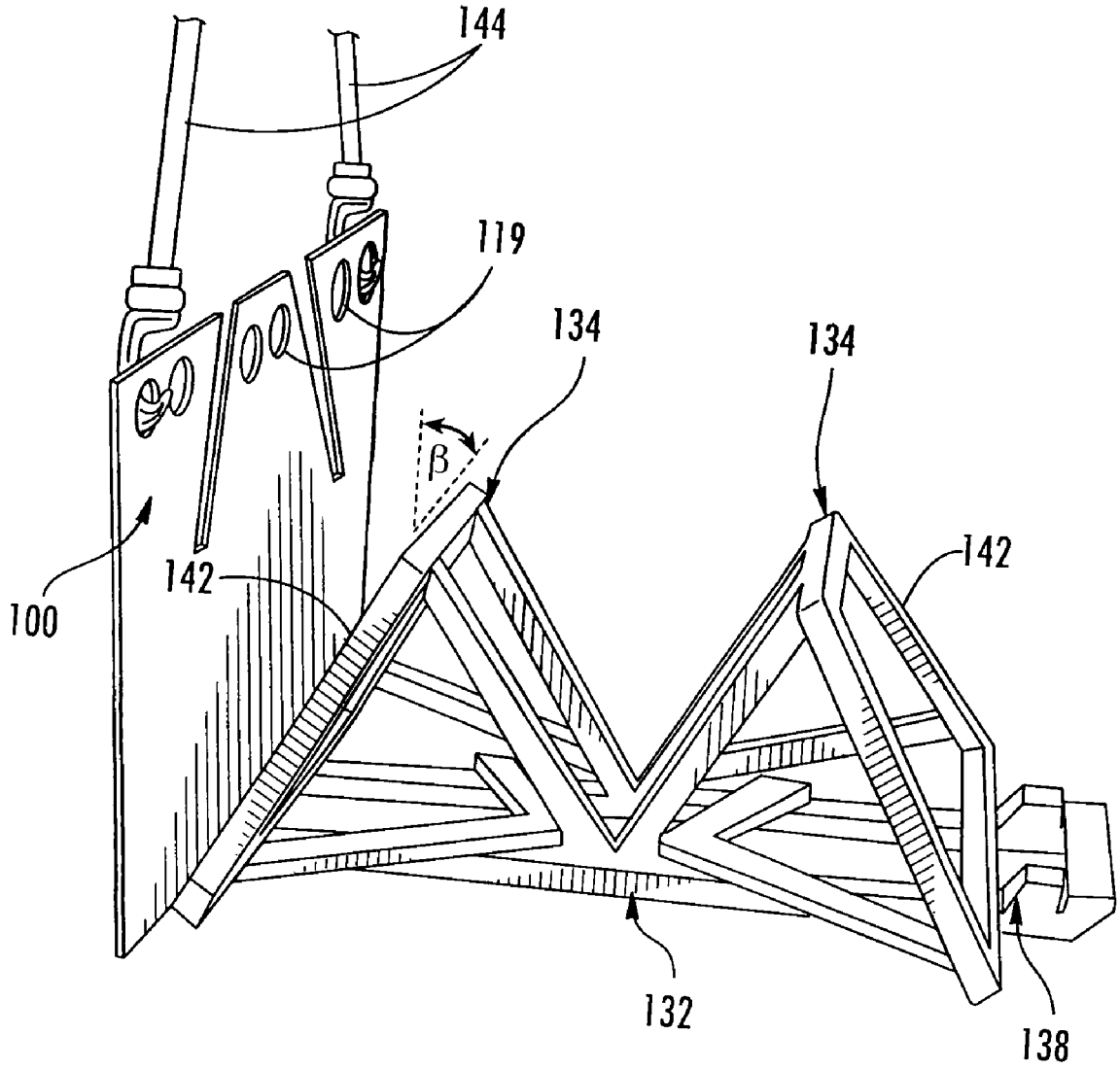
FIGS. 18-25 show assembly of a target using the jig of FIG. 16.
Figure 19:
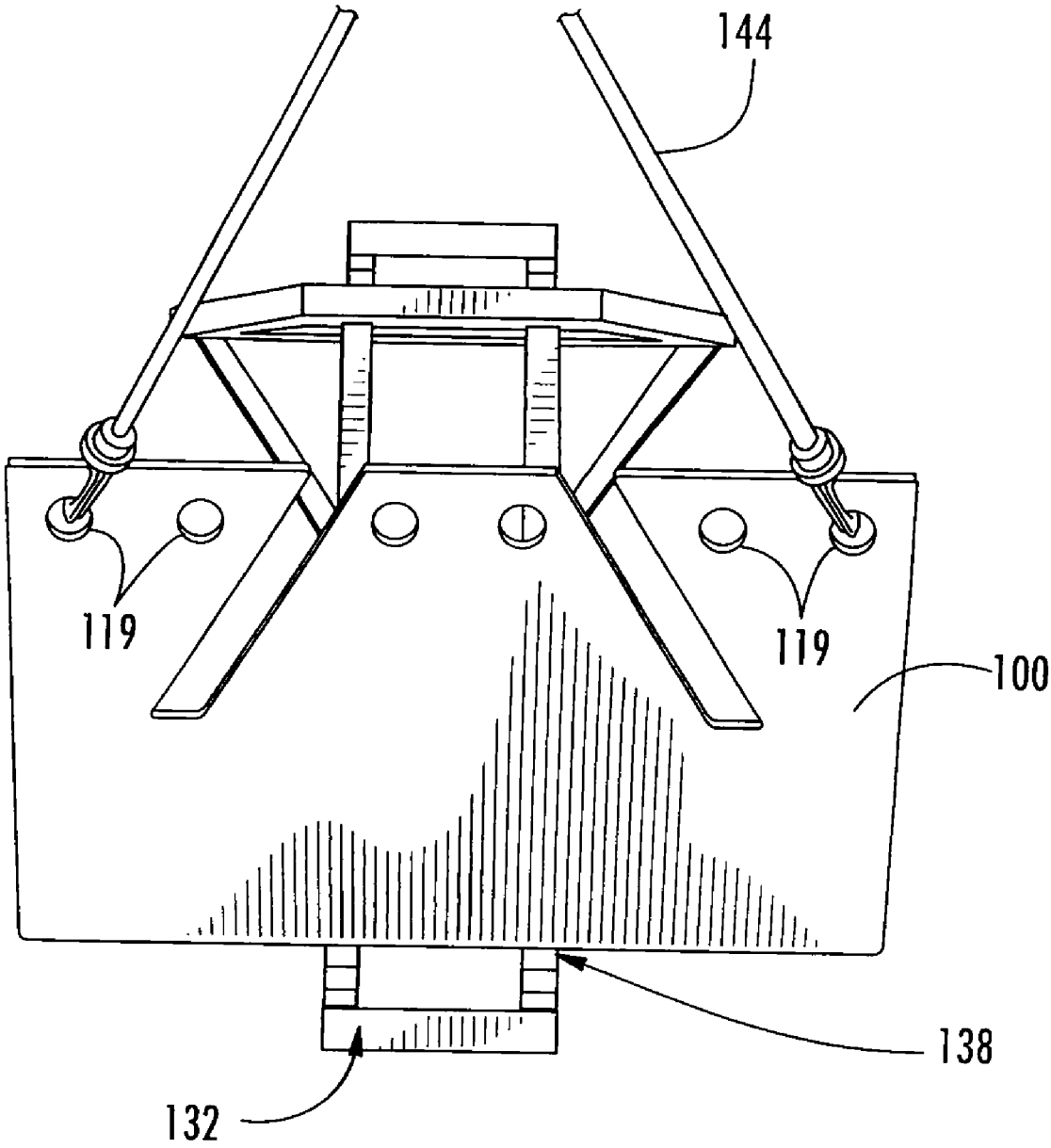
Figure 20:
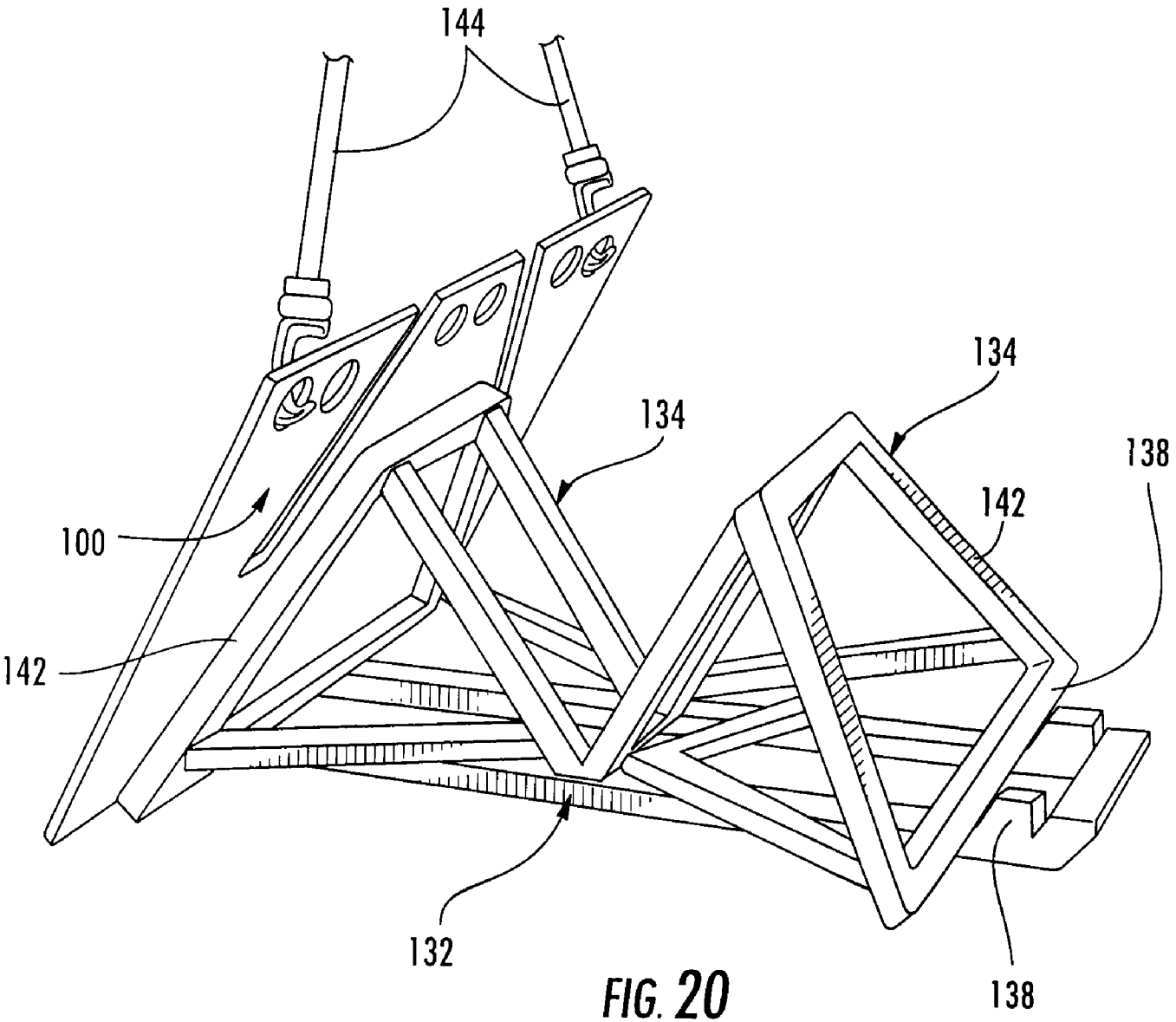
Figure 21:
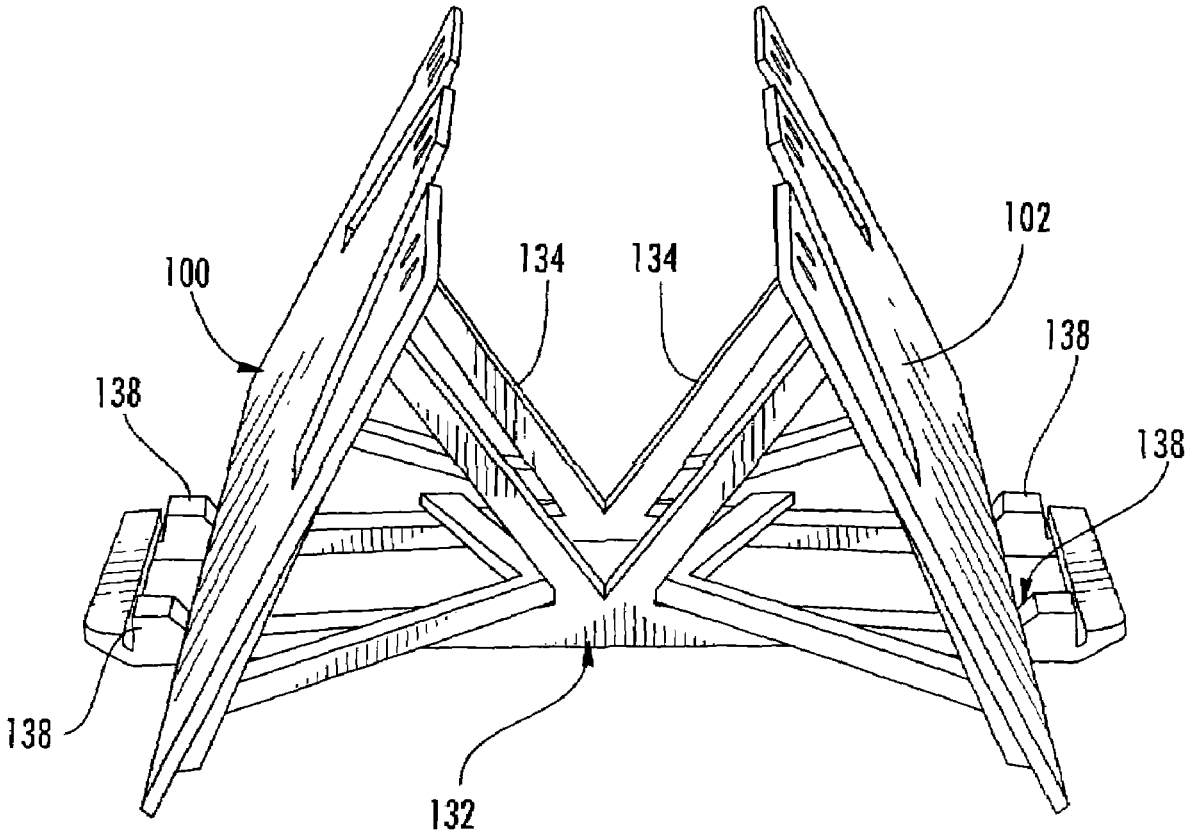

As seen in FIGS. 18-20, the side plate 100 of the target 16 is installed on the jig 130 with the lower edge of the plate 100 against the angled stops 138. The side plate 100 is preferably installed as by use of a crane or the like utilizing lifting members 144 connected to selected ones of the apertures 119. The second side plate 102 is then installed in a similar manner (FIG. 21).

Figure 22:
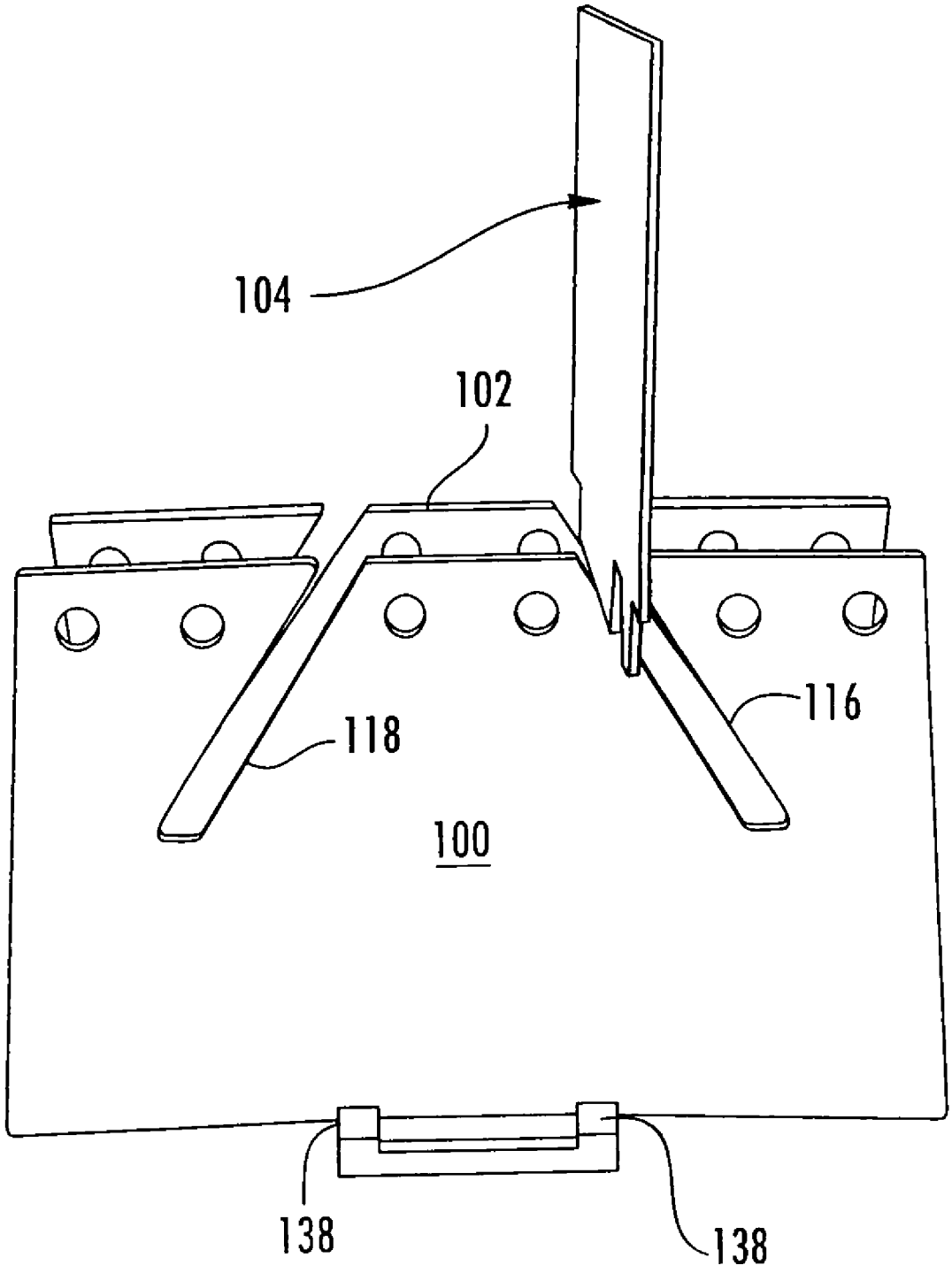
Figure 23:
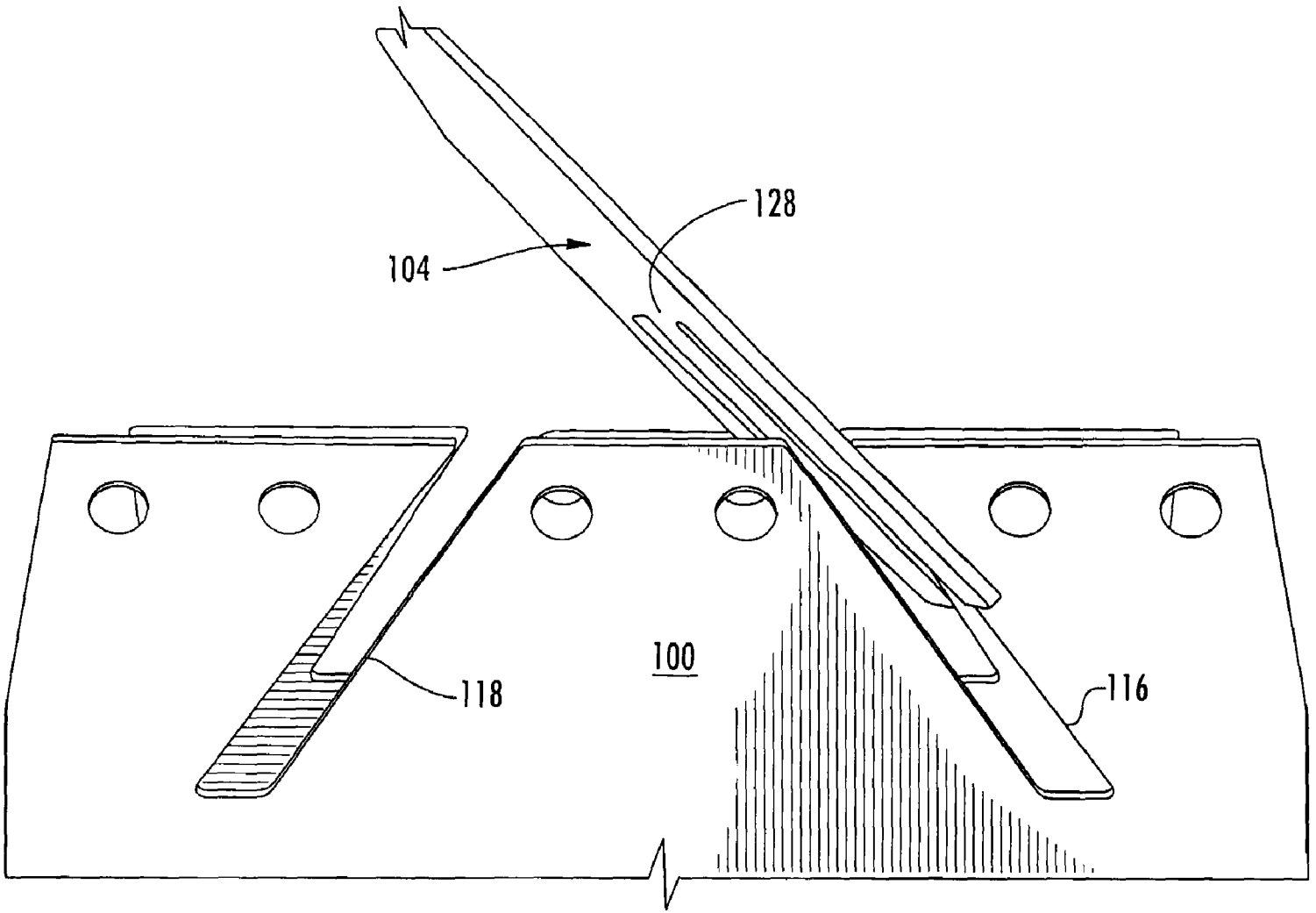
Figure 24:
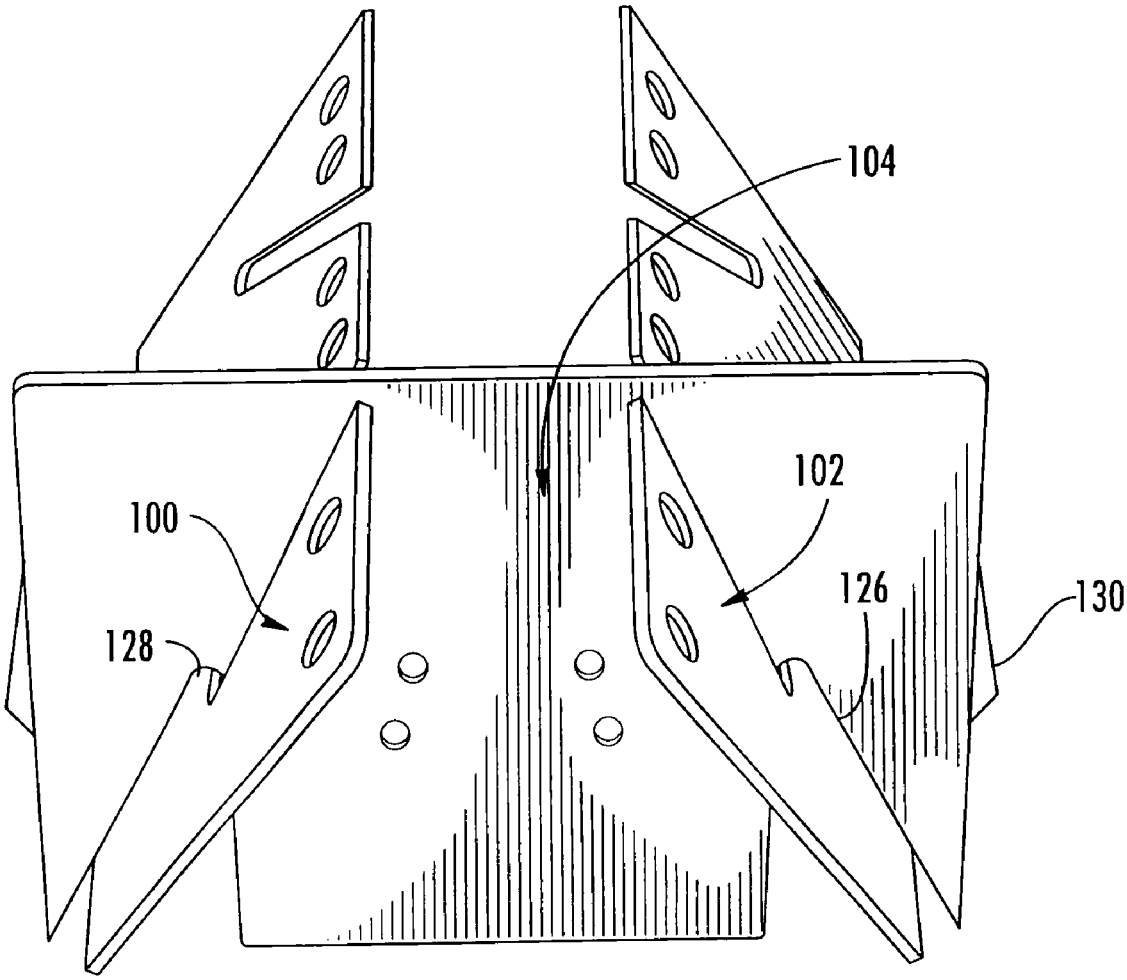
Figure 25:
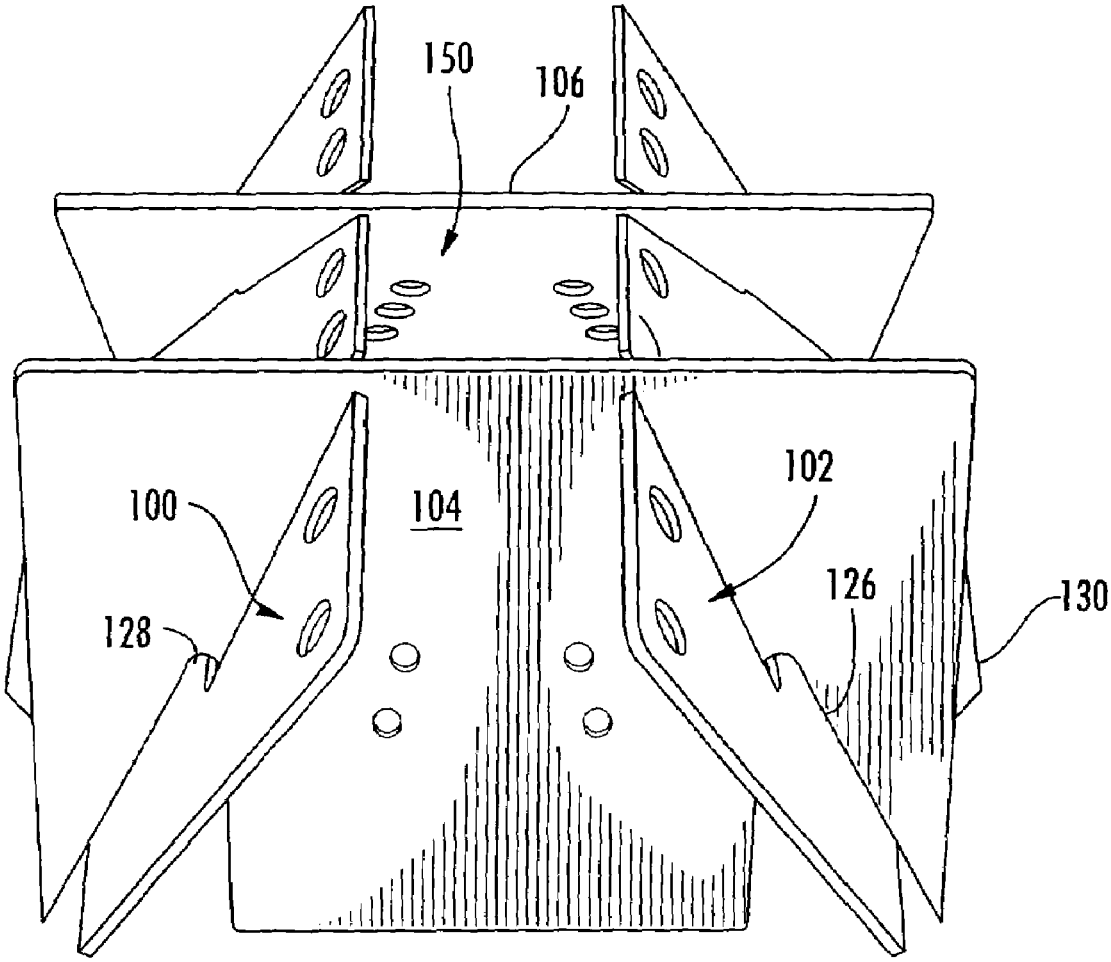

Continuing to FIGS. 22-24, the end plate 104 is installed (preferably as by a crane) using the lifting members 144 supporting the plate 104 via the apertures 125 or the cutouts 126/128, by positioning the cutouts 126 and 128 within the grooves 116 and 118 of the end plate 104 and desirably orienting the end plate 104. The end plate 106 is then installed in the same manner to yield the assembled target 16 (FIG. 25). It will be understood that the targets 10-14 may be assembled in a similar manner.

The foregoing described targets 10-16 and the described assembly render the targets more suitable for transporting and positioning at a target range as compared to conventional targets such as surplus tanks, jeeps, and other military vehicles typically utilized for targets. For example, surplus military vehicles typically must be prepared for use as targets, with such preparation including labor intensive steps of draining fluids such as oil, gasoline, hydraulic fluids, and the like, checking compartments for ammunition or other hazards left behind, and other preparatory steps aimed at removing potentially hazardous materials, such as radioactive dials and gauges, from the vehicles. As will be appreciated, targets according to the invention, such as the targets 10-16 are made of steel, plastic or similar plate materials and do not have such fluids or other hazards and thus do not require such pre-use preparation.

The targets 10-16 are also typically considerably lighter in weight as compared to corresponding conventional targets of the same appearance and dimension. For example, the targets 10 and 12 which imitate the appearance of a military tank typically weigh a small fraction of the weight of a conventional tank. For example, the target 10 made of steel plate having a thickness of about 0.75 inches and configured as described preferably has a weight of less than about 7 tons and the target 12 has a weight of about 2.5 tons, whereas a conventional tank of comparable dimension generally has a weight of about 67 tons.

In addition, the targets of the invention overcome other shortcomings associated with the use of conventional targets. For example, when conventional targets are hit by artillery or the like, such targets tend to fracture and blow apart, requiring periodic maintenance, as by pushing the remaining parts together using a bulldozer. Also, such fracturing complicates removal of the target, as the widespread debris pieces must be located and retrieved.

As will be appreciated, providing safe ingress and egress for the bulldozer complicates such repair. For example, as target ranges typically have some level of unexploded ordnance (UXO) thereon, UXO clearance must be obtained in order to ingress/egress a location on the range. This typically requires labor intensive and time consuming clearance of a specific path as by use of specially trained personnel with metal detectors or the like to sweep and mark a travel path for the bulldozer. As will be appreciated, this is time consuming and expensive and also shuts down proximate areas of the range during this time and the time during which the target is accessed. Thus, providing a target structure which substantially eliminates or avoids such periodic maintenance can enable significant reductions in costs associated with the operation of the target range. It has also been observed that the targets 10-16 are substantially more durable as compared to conventional targets, thus further reducing costs associated with locating and removing targets, as the targets may remain in use for longer periods of time and with little or no maintenance.

In this regard, it has been observed that the construction and configuration of the described targets advantageously minimizes fracturing of the targets and the associated repair and clean-up. Conventional targets are often substantially enclosed structures which do not rapidly vent explosive gases and are otherwise constructed from a large number of small components which can be disengaged from one another when subjected to explosive munitions. The construction of the targets 10-16 advantageously offers a minimum of components and provides a relatively open structure which has been observed to advantageously enable gases from explosive munitions to be rapidly vented to the atmosphere such that stresses on the target are reduced. For example, as will be appreciated in FIG. 25, the target 25 has only the plates 100-108 and the gussets 127 and 129 and provides a substantial open area 150 through which explosive gases may vent.

The targets 10-16 are also more easily positioned on a target range and removed from a target range as compared to conventional targets. For example, conventional targets are relatively heavy and more difficult to transport as compared to the targets 10-16. The components of the targets 10-16 are relatively lightweight and may be stacked on a truck or other transport for transportation to the target range in a compact and economical manner. Once at the target range, the components may be quickly and easily assembled into the targets 10-16 as described. Alternatively, the targets may be transported on a truck or the like in an assembled condition. The targets 10-16 may then be easily moved to desired locations much easier than conventional targets.

Figure 26:
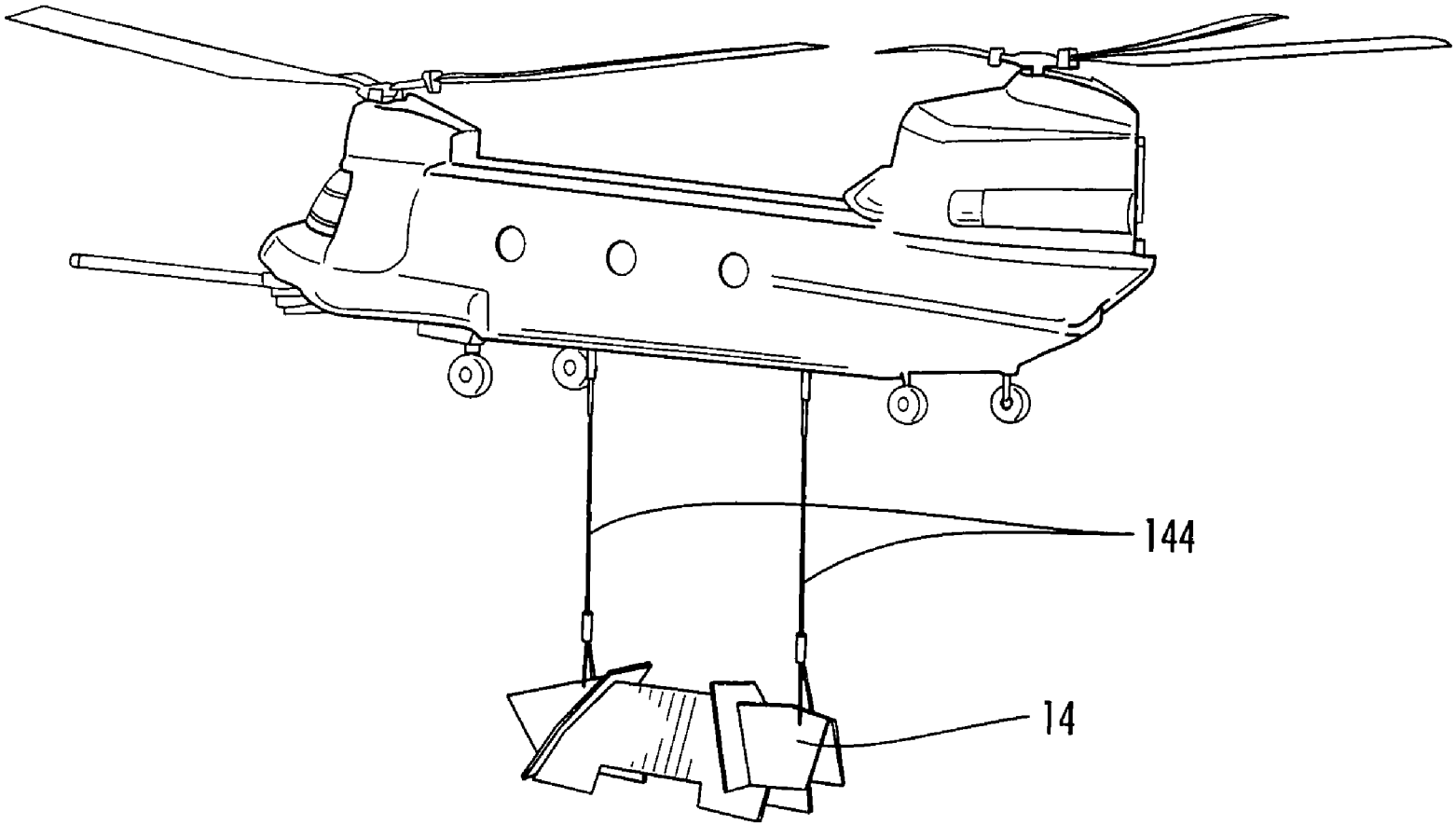
FIGS. 26-28 show preferred manners of transportation of targets.
Figure 27:
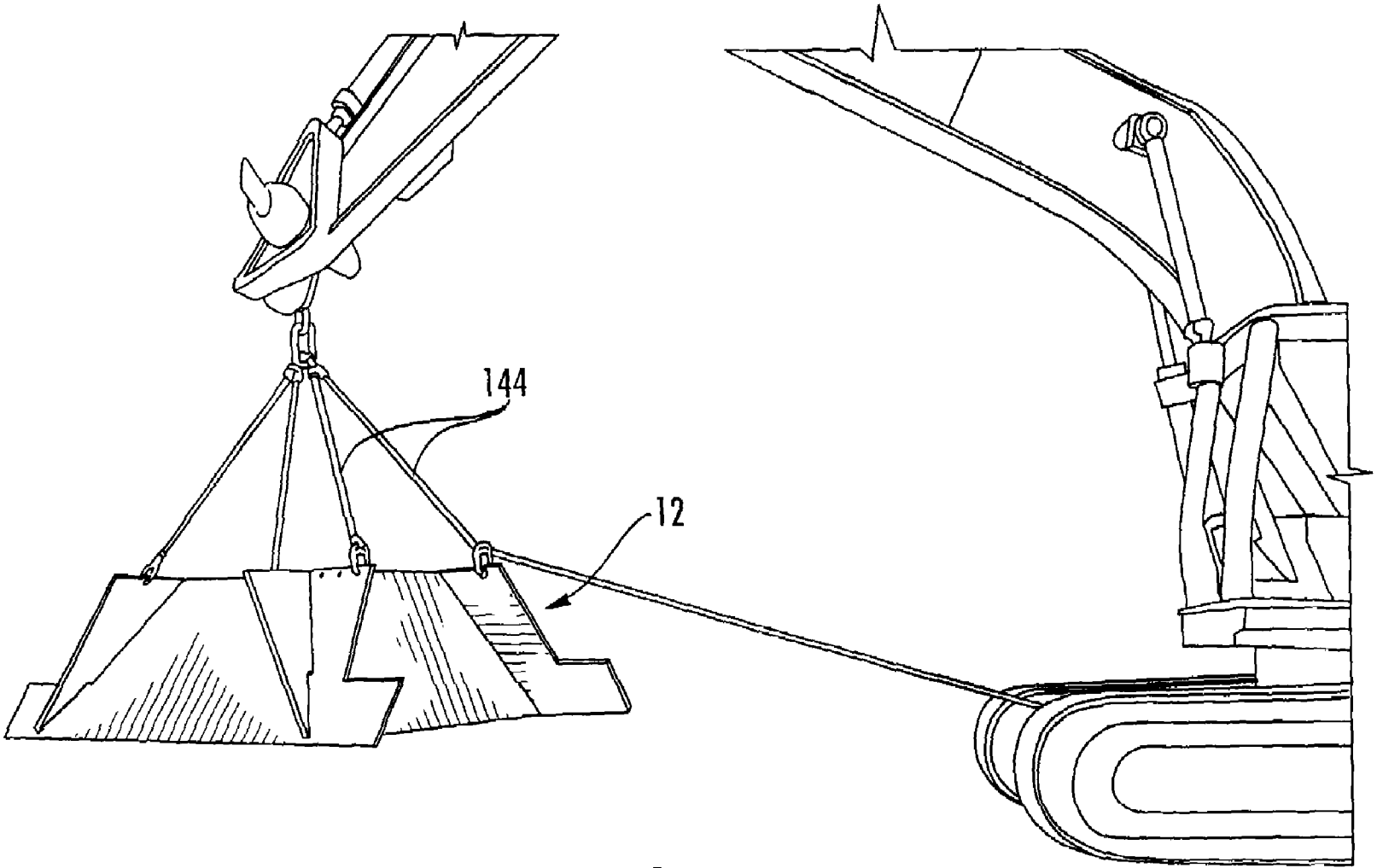
Figure 28:
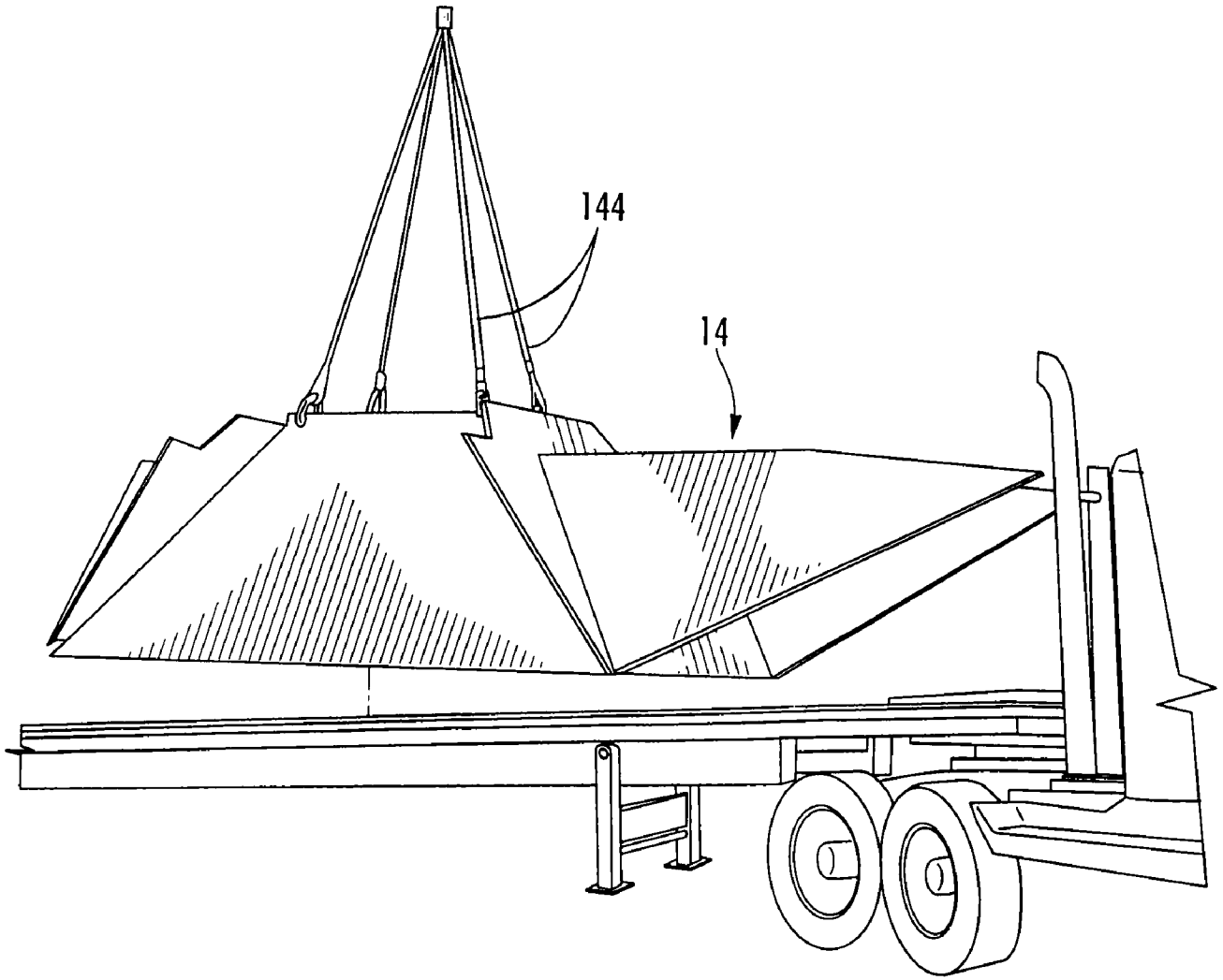

With reference to FIGS. 26-28, targets according to the invention are shown being moved or transported. FIG. 26 shows one of the targets 14 being transported by a helicopter. FIG. 27 shows one of the targets 12 being transported by a crane. FIG. 28 shows one of the targets 14 being lifted off a truck by a crane.

Accordingly, the construction of the targets 10-16 yields target structures which avoid fracturing from their assembled state and which are lightweight and more easily transported as compared to conventional targets. The construction of the targets 10-16 also facilitates placement and removal of the targets from the target range and recycling thereof. In this regard and for the purpose of example, it will be appreciated that in the conventional operation of a target range, safe access must be provided to position a target and at the end of the useful life of a conventional target, a recovery team must travel through or be present directly on the range, gather the pieces for removal, and again travel through or be directly present on the range for removal. As such, safe ingress and egress routes must be provided, with steps taken to provide UXO clearance. Furthermore, the recovered debris must be inspected for hazards and otherwise processed, and is generally not readily accepted for salvage.

For the reasons set forth herein, the construction of the targets 10-16 greatly simplify placement, recovery, and recycling, as the targets may be easily transported by air, as by helicopter, thus avoiding or substantially reducing the need to clear ingress/egress routes. Likewise, as the targets 10-16 remain substantially intact and avoid fragmentation or the like, retrieval is simplified as the need to retrieve fragments and other debris is avoided or at least substantially reduced. The targets may also be recovered as by helicopter, thus again avoiding or reducing the UXO clearance needed. In addition, the relatively lightweight nature of the targets renders the use of more lightweight ground transport vehicles, thus reducing the ingress/egress requirements in the event ground transport is preferred. That is, in the event ground transportation for the delivery or removal of the targets is utilized, the width of the path that must receive UXO clearance may be reduced, thus reducing the time and expense for UXO clearance.

As will be further appreciated, conventional targets may often not be suitable for recycling due to the potential presence of fluids, munitions in hidden compartments, and a number of other potential hazards inherent to the use of used military vehicles as targets, such as the presence of radioactive gauges and the like. Thus, in the event such targets are considered for recycling, such targets must be inspected and cleaned, such inspection and cleaning representing considerable effort and expense. The targets 10-16 avoid such hazards and are more suitable for recycling and eliminate or reduce inspection requirements. For example, the targets 10-16 are originally of new construction and do not present hidden hazards in the manner of used vehicles, and are constructed of recyclable materials, such as steel or plastic plates which are more readily recycled than conventional targets.

Figure 29:
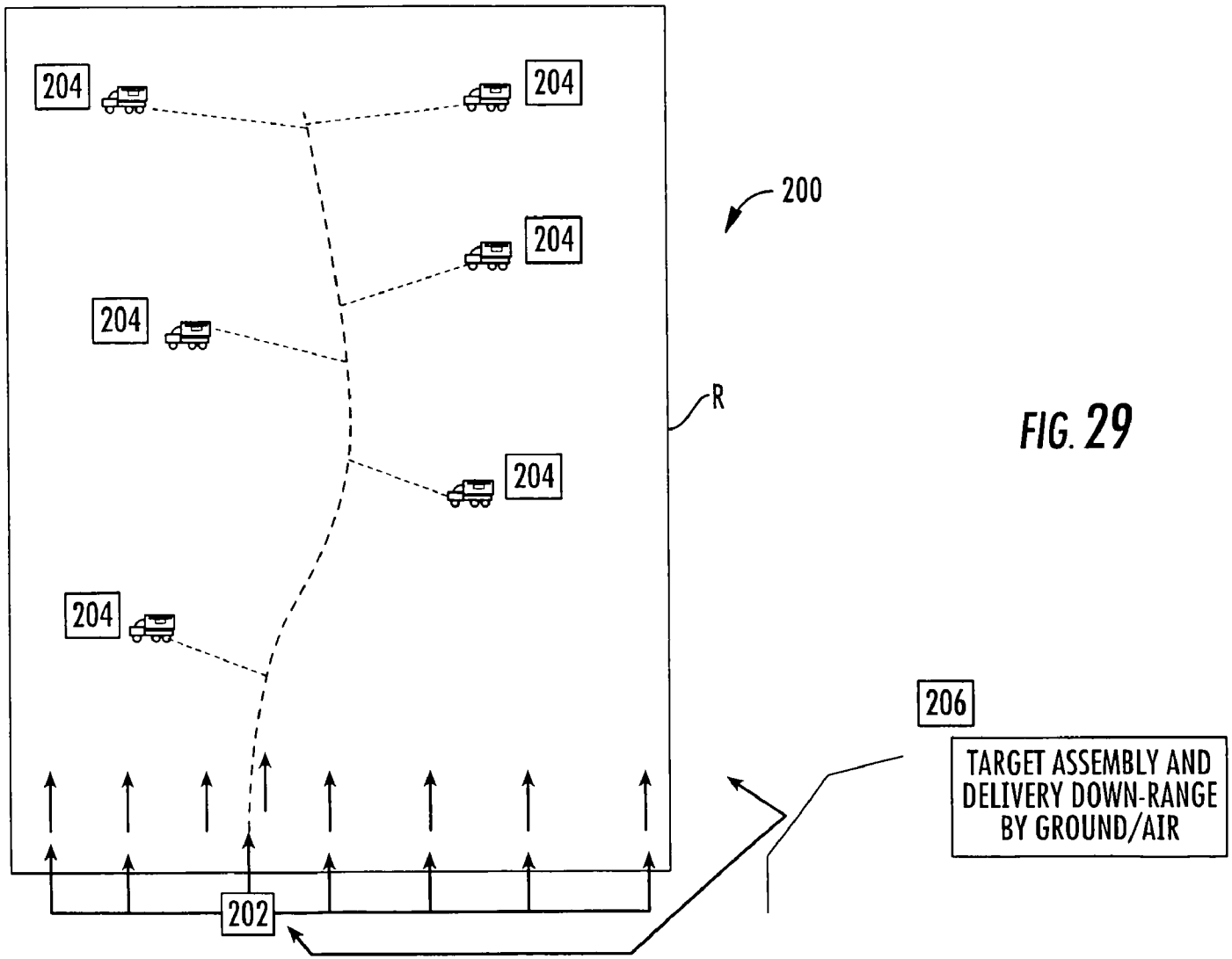
FIG. 29 shows steps in a preferred method for operating a target range.

Another aspect of the invention relates to the efficient operation of a target range utilizing targets such as the targets 10-16 to achieve significant cost savings and avoiding many of the environmental and other disadvantages associated with conventional target ranges. Accordingly, with reference to FIG. 29, there is shown an overview of steps in a preferred method 200 for operating a target range.

In a first step 202, a target range indicated by the outline R, is cleared for ingress/egress, the paths being indicated by the arrows and dashed lines on the range R. This may range from UXO clearance of the entire range to UXO clearance of a specific path or paths to existing targets. In one or more steps 204, the accessed targets are removed from the range via the egress paths. As explained previously, when the targets 10-16 are utilized, the paths may be of reduced dimension as compared to paths required for conventional targets. Use of the targets 10-16 also enables use of air paths, as by use of a helicopter, again representing a path of reduced dimension. In addition, when the removed targets are the targets 10-16, they may be readily recycled, and the revenues from recycling utilized to offset costs associated with the operation of the range.

In a preferred step 206, one or more new targets, such as the targets 10-16, are assembled and placed on the range via the paths. The targets may be positioned by ground transport or by air transport such as by helicopter. Alternatively, the target components may be transported to the desired sites on the range and assembled at the desired sites. Once again, the use of the targets 10-16 enables a reduction of the ingress/egress paths needed for installation of the targets, thus representing significant cost savings for the reasons previously described.

The foregoing description of certain exemplary embodiments of the present invention has been provided for purposes of illustration only, and it is understood that numerous modifications or alterations may be made in and to the illustrated embodiments without departing from the spirit and scope of the invention as defined in the following claims.

What is claimed is:

1. A method for operating a target range, the method comprising the steps of:

providing a target consisting of a first pair of plates each having a pair of grooves and a second pair of plates configured for being received by the grooves of the first plates, wherein the plates are made of recyclable material and devoid of hazards comprising munitions, fuels, and radioactive materials;

assembling the target by positioning the first plates in a side by side orientation at an angle to one another and positioning each one of the second pair of plates within the grooves of the plates of the first pair of plates such that the plates of the second pair of plates are at an angle to one another and spaced apart to provide an assembled target;

positioning the target on a target range;

repeatedly subjecting the target to impacts from ordnance or munitions, wherein the target substantially remains in an assembled state after such impacts; and removing the target from the target range.

2. The method of claim 1, further comprising the step of recycling the first and second pair of plates after the step of removing the target from the target range.

3. The method of claim 1, wherein the recyclable material is selected from the group consisting of metals and plastics.

4. The method of claim 1, wherein the step of positioning the target on a target range comprises transporting the first and second pairs of plates to a desired location on a target range prior to the step of assembling the target.

5. The method of claim 1, wherein the step of positioning the target on a target range comprises positioning the target in an assembled state, wherein the step of assembling the target is performed at a location remote from the location on the range where the target is positioned for use.

6. The method of claim 1, wherein the step of assembling the target comprises providing a jig having one or more frame members for supporting the first plates in a side by side orientation at an angle to one another; positioning the first plates on the jig; and positioning each one of the second pair of plates at an angle to one another within the grooves of the plates of the first pair of plates to provide the assembled target; and removing the assembled target from the jig.

7. The method of claim 1, wherein each of the first pair of plates further includes apertures therethrough and the step of positioning the assembled target on a target range comprises connecting lifting members to one or more of the apertures of the first pair of plates; lifting the assembled target by use of the lifting members; and transporting the target to the target range in the lifted state.

8. The method of claim 7, wherein the step of removing the target from the target range comprises connecting lifting members to one or more of the apertures of the first pair of plates; lifting the assembled target by use of the lifting members, and transporting the target from the target range in the lifted state.

9. The method of claim 8, wherein the step of lifting the target comprises connecting the lifting members to a helicopter and operating the helicopter to lift and transport the target.

10. The method of claim 1, further comprising the step of providing an ingress route for placement of the target, wherein the ingress route has a reduced dimension as compared to a conventional ingress route.

* * * * *